US008903275B2

(12) United States Patent
Naitoh

(10) Patent No.: US 8,903,275 B2
(45) Date of Patent: Dec. 2, 2014

(54) FIXING DEVICE AND IMAGE FORMING APPARATUS INCORPORATING SAME

(75) Inventor: Yutaka Naitoh, Itami (JP)

(73) Assignee: Ricoh Company, Limited, Tokyo (JP)

( * ) Notice: Subject to any disclaimer, the term of this patent is extended or adjusted under 35 U.S.C. 154(b) by 415 days.

(21) Appl. No.: 12/805,229

(22) Filed: Jul. 20, 2010

(65) Prior Publication Data

US 2011/0026944 A1 Feb. 3, 2011

(30) Foreign Application Priority Data

Jul. 29, 2009 (JP) ..... 2009-176268

(51) Int. Cl.
*G03G 15/20* (2006.01)

(52) U.S. Cl.
CPC ..... *G03G 15/2085* (2013.01)
USPC ..... 399/122; 399/398

(58) Field of Classification Search
CPC ..... B65H 29/54; B65H 29/56; G03G 15/20
USPC ..... 399/122, 398, 399, 400
See application file for complete search history.

(56) References Cited

U.S. PATENT DOCUMENTS

| | | | | |
|---|---|---|---|---|
| 3,991,999 | A * | 11/1976 | Brooke | 271/308 |
| 4,252,310 | A | 2/1981 | Kono et al. | |
| 4,281,623 | A | 8/1981 | Kato et al. | |
| 4,752,811 | A * | 6/1988 | Takahashi | 399/399 |
| 5,500,726 | A * | 3/1996 | Aoyama et al. | 399/339 |
| 5,802,434 | A * | 9/1998 | Takehara et al. | 399/323 |
| 2002/0164172 | A1 | 11/2002 | Tsubaki et al. | |
| 2008/0056783 | A1 | 3/2008 | Yamamoto et al. | |
| 2008/0193162 | A1 | 8/2008 | Yamazoe et al. | |
| 2009/0060572 | A1 | 3/2009 | Naitoh et al. | |
| 2009/0074440 | A1 | 3/2009 | Nanno et al. | |
| 2009/0297233 | A1 * | 12/2009 | Kameda | 399/322 |
| 2010/0034548 | A1 | 2/2010 | Naitoh et al. | |
| 2010/0232848 | A1 | 9/2010 | Naitoh | |

FOREIGN PATENT DOCUMENTS

| | | | | |
|---|---|---|---|---|
| JP | 53-136149 | | 10/1978 | |
| JP | 54-153241 | | 10/1979 | |
| JP | 55088084 | A * | 7/1980 | G03G 15/14 |
| JP | 56162769 | A * | 12/1981 | G03G 15/14 |

(Continued)

OTHER PUBLICATIONS

European Search Report dated Nov. 23, 2011 for corresponding European Application No. 10168935.4.

(Continued)

*Primary Examiner* — Nguyen Ha
(74) *Attorney, Agent, or Firm* — Harness, Dickey & Pierce, P.L.C.

(57) ABSTRACT

In a fixing device, a fixing member contacts an opposing member to form a nip therebetween through which a recording medium bearing a toner image passes. A plurality of separators provided downstream from the nip in a recording medium conveyance direction contacts the fixing member to separate the recording medium having passed between the fixing member and the opposing member from the fixing member. A plurality of contact-direction biasing members connected to the plurality of separators biases the separators to cause the separators to contact the fixing member. A releasing member contacts the separators to cause the separators to separate from the fixing member. A driver connected to the releasing member separates the releasing member from the separators to cause the separators to contact the fixing member.

14 Claims, 7 Drawing Sheets

(56) References Cited

FOREIGN PATENT DOCUMENTS

| | | | | | |
|---|---|---|---|---|---|
| JP | 58-044474 | | | 3/1983 | |
| JP | 58-044478 | | | 3/1983 | |
| JP | 59-184383 | | | 10/1984 | |
| JP | 61-230179 | | | 10/1986 | |
| JP | 61230179 | A | * | 10/1986 | G03G 15/20 |
| JP | 62052579 | A | * | 3/1987 | B65H 29/56 |
| JP | 01202781 | A | * | 8/1989 | G03G 15/20 |
| JP | 02111984 | A | * | 4/1990 | G03G 15/00 |
| JP | 03157682 | A | * | 7/1991 | |
| JP | 03168679 | A | * | 7/1991 | G03G 21/00 |
| JP | 04-125583 | | | 4/1992 | |
| JP | 05107975 | A | * | 4/1993 | G03G 21/00 |
| JP | 07-140831 | | | 6/1995 | |
| JP | 09-305053 | | | 11/1997 | |
| JP | 10-040871 | | | 2/1998 | |
| JP | 10260606 | A | * | 9/1998 | B65H 29/56 |
| JP | 2001337563 | A | * | 12/2001 | G65H 29/56 |
| JP | 2002-082562 | | | 3/2002 | |
| JP | 2003-186336 | | | 7/2003 | |
| JP | 2004-067329 | | | 3/2004 | |
| JP | 2004198896 | A | * | 7/2004 | G03G 15/00 |
| JP | 2004279927 | | | 10/2004 | |
| JP | 2005-024645 | | | 1/2005 | |

OTHER PUBLICATIONS

European Search Report dated Nov. 23, 2011 for corresponding European Application No. 11174029.6.

Office Action for corresponding Chinese patent application No. 201110208060.9 dated Sep. 4, 2013.

Office Action for corresponding Chinese patent application No. 2010-167286 dated Dec. 24, 2013.

* cited by examiner

FIXING DEVICE AND IMAGE FORMING APPARATUS INCORPORATING SAME

PRIORITY STATEMENT

The present patent application claims priority from Japanese Patent Application No. 2009-176268, filed on Jul. 29, 2009 in the Japan Patent Office, which is hereby incorporated herein by reference in its entirety.

BACKGROUND OF THE INVENTION

1. Field of the Invention

Example embodiments generally relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a fixing member heated by a heater, and a pressing member that presses against the fixing member to form a fixing nip between the fixing member and the pressing member. As a recording medium bearing a toner image passes between the fixing member and the pressing member, the fixing member and the pressing member apply heat and pressure to the recording medium to melt and fix the toner image on the recording medium. Thereafter, the recording medium bearing the fixed toner image is discharged from the fixing nip.

However, it can happen that the recording medium bearing the toner image facing the fixing member gets stuck to the surface of the fixing member due to the adhesive force of the melted toner of the toner image. As a result, the recording medium may not be discharged from the fixing nip properly.

To address this problem, a separator such as a separation pawl may contact the surface of the fixing member against the direction of rotation of the fixing member to separate the recording medium from the fixing member. However, because the separator remains in constant contact with the rotating fixing member, the surface of the fixing member contacted by the separator experiences wear over time. As a result, the worn fixing member may generate streaks and uneven glosses on the toner image.

To address this problem, the fixing device may further include a separator protection mechanism provided downstream from the fixing nip in the recording medium conveyance direction to separate the separator from the fixing member. When the recording medium lifts the separator protection mechanism, the separator, which is interlocked with the separator protection mechanism via a connecting member, is separated from the fixing member. Accordingly, whenever the recording medium passes between the fixing member and the pressing member and lifts the separator protection mechanism, the separator is separated from the fixing member to suppress wear of the surface of the fixing member due to friction caused by the separator sliding over the fixing member.

However, a separator configured to separate from the fixing member only when the recording medium passes between the fixing member and the pressing member as described above may not be effective in reducing wear of the surface of the fixing member during warm-up of the fixing device, because more time is used to warm up the fixing device or to idle the fixing member than to feed the recording medium between the fixing member and the pressing member.

Alternatively, the fixing device may include a sensor for detecting the recording medium conveyed toward the fixing nip formed between the fixing member and the pressing member and a solenoid for controlling the separator according to a detection signal provided by the sensor. With this configuration, the separator contacts the fixing member only when the recording medium passes between the fixing member and the pressing member. Accordingly, the separator remains separated from the fixing member otherwise and thus for a longer time compared to a configuration in which the separator separates from the fixing member only when the recording medium passes between the fixing member and the pressing member, thus decreasing wear of the fixing member.

However, each separator requires its own solenoid. Consequently, when a plurality of separators is provided in the fixing device, a plurality of solenoids is needed, resulting in a bigger fixing device and increased manufacturing costs. Moreover, when each of the plurality of solenoids is designed to respond at different times, the plurality of separators may not move simultaneously.

To address this problem, the plurality of separators may be combined with each other and a single solenoid may move the combined separators collectively. FIG. 1 is a schematic view of a known fixing device 20R including a plurality of separators 230 connected to each other by a connecting member 220, and contacting a fixing member 210 to separate the recording medium from the fixing member 210.

However, if there are variations in the dimensions of the individual separators 230 or the fixing member 210 is bent or vibrates, a slight gap S may arise between one of the plurality of separators 230 (for example, the center separator 230) and the fixing member 210. As a result, if all of the separators 230 do not contact the fixing member 210 simultaneously, the recording medium may not be separated from the fixing member 210 properly.

SUMMARY

At least one embodiment may provide a fixing device that includes a fixing member, an opposing member, a plurality of separators, a plurality of contact-direction biasing members, a releasing member, and a driver. The opposing member is disposed opposite the fixing member to contact the fixing member to form a nip between the fixing member and the opposing member through which a recording medium bearing a toner image passes. The plurality of separators is provided downstream from the nip in a recording medium conveyance direction to contact and separate from the fixing member independently from each other. The plurality of separators contacts the fixing member to separate the recording medium having passed between the fixing member and the opposing member from the fixing member. The plurality of contact-direction biasing members is connected to the plurality of separators to bias the plurality of separators to cause the plurality of separators to contact the fixing member. The releasing member is rotatively provided to contact and separate from the plurality of separators. The releasing member contacts the plurality of separators to cause the plurality of separators to separate from the fixing member against the bias of the plurality of contact-direction biasing members. The driver is connected to the releasing member to separate the releasing member from the plurality of separators to cause the plurality of contact-direction biasing members connected to the plurality of separators to cause the plurality of separators to contact the fixing member.

At least one embodiment may provide an image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
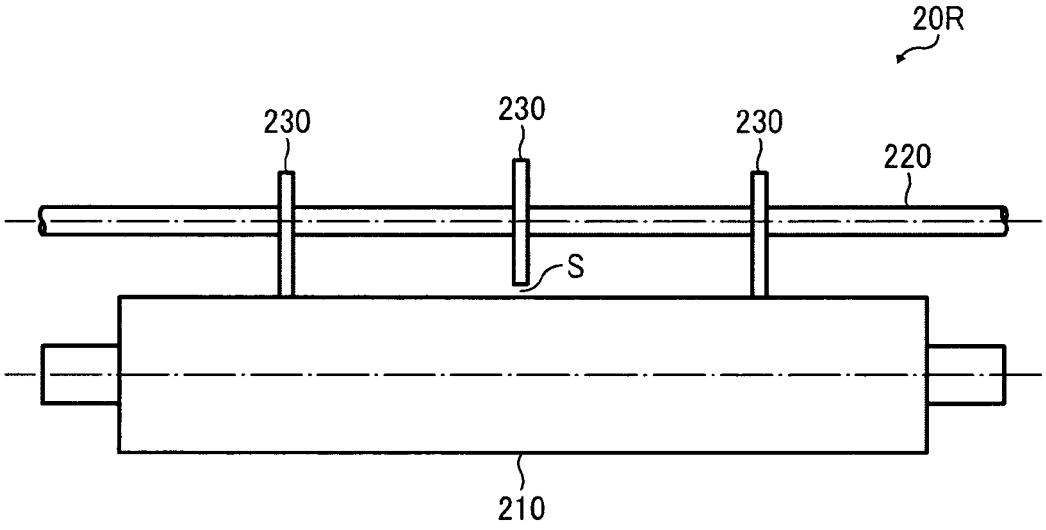
FIG. 1 RELATED ART
FIG. 1 is a schematic view of a related-art fixing device.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 2:
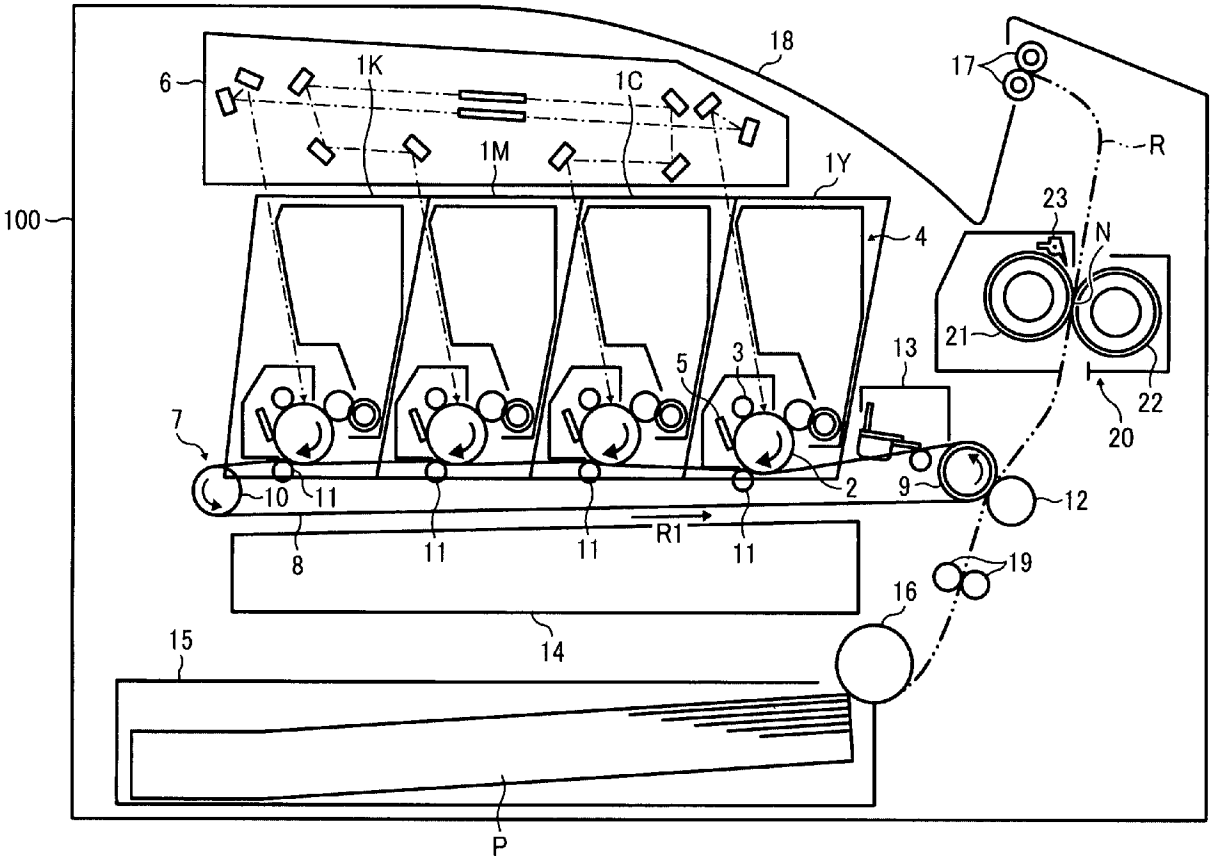
FIG. 2 is a schematic view of an image forming apparatus according to an example embodiment.

Referring now to the drawings, wherein like reference numerals designate identical or corresponding parts throughout the several views, particularly to FIG. 2, an image forming apparatus 100 according to an example embodiment is explained.

FIG. 2 is a schematic view of the image forming apparatus 100. As illustrated in FIG. 2, the image forming apparatus 100 includes process units 1Y, 1C, 1M, and 1K, an exposure device 6, a transfer device 7, a second transfer roller 12, a belt cleaner 13, a waste toner container 14, a paper tray 15, a feed roller 16, an output roller pair 17, an output tray 18, a registration roller pair 19, a fixing device 20, and a conveyance path R.

The process unit 1Y includes a photoconductive drum 2, a charging roller 3, a development device 4, and a cleaning blade 5. The transfer device 7 includes an intermediate transfer belt 8, a driving roller 9, a driven roller 10, and first transfer rollers 11. The fixing device 20 includes a fixing roller 21, a pressing roller 22, and separators 23.

As illustrated in FIG. 2, the image forming apparatus 100 may be a copier, a facsimile machine, a printer, a multifunction printer having at least one of copying, printing, scanning, plotter, and facsimile functions, or the like. The image forming apparatus 100 may form a color image and/or a monochrome image by electrophotography. According to this example embodiment, the image forming apparatus 100 is a copier for forming a color image on a recording medium by electrophotography.

The four process units 1Y, 1C, 1M, and 1K are detachably attached to the image forming apparatus 100. The process units 1Y, 1C, 1M, and 1K contain and use toners in different colors (e.g., yellow, cyan, magenta, and black colors corresponding to color separation components of a color image), respectively, but have a similar structure. Accordingly, the following describes the structure of the process unit 1Y which is equivalent to the structure of the process units 1C, 1M, and 1K.

In the process unit 1Y, the photoconductive drum 2 (e.g., a photoconductor) serves as an image carrier for carrying an electrostatic latent image. The charging roller 3 serves as a charger for charging a surface of the photoconductive drum 2. The development device 4 serves as a development device for supplying developer (e.g., toner) to the surface of the photoconductive drum 2. The cleaning blade 5 serves as a cleaner for cleaning the surface of the photoconductive drum 2.

The exposure device 6 is provided above the process units 1Y, 1C, 1M, and 1K, and serves as an electrostatic latent image formation member for exposing the charged surfaces of the photoconductive drums 2. The transfer device 7 is provided below the process units 1Y, 1C, 1M, and 1K. In the transfer device 7, the intermediate transfer belt 8, that is, an endless belt serving as a transfer member, is stretched over the driving roller 9 and the driven roller 10, and moves and rotates in a rotation direction R1.

The four first transfer rollers 11, serving as first transfer members, are disposed opposite the four photoconductive drums 2 of the process units 1Y, 1C, 1M, and 1K, respectively. The first transfer rollers 11 contact an inner circumferential surface of the intermediate transfer belt 8, and press against the photoconductive drums 2 via the intermediate transfer belt 8 to form first transfer nips between the photoconductive drums 2 and the intermediate transfer belt 8 at positions at which the photoconductive drums 2 contact the intermediate transfer belt 8, respectively. The second transfer roller 12, serving as a second transfer member, is disposed opposite the driving roller 9. The second transfer roller 12 contacts an outer circumferential surface of the intermediate transfer belt 8, and presses against the driving roller 9 via the intermediate transfer belt 8 to form a second transfer nip between the second transfer roller 12 and the intermediate transfer belt 8 at a position at which the second transfer roller 12 contacts the intermediate transfer belt 8.

The belt cleaner 13 faces the outer circumferential surface of the intermediate transfer belt 8 at a right end of the intermediate transfer belt 8 in FIG. 2, and cleans the outer circumferential surface of the intermediate transfer belt 8. A waste toner conveyance hose extending from the belt cleaner 13 is connected to an inlet of the waste toner container 14 provided below the transfer unit 7 to connect the belt cleaner 13 to the waste toner container 14.

The paper tray 15 and the feed roller 16 are provided in a lower portion of the image forming apparatus 100. The paper tray 15 contains recording sheets P serving as recording media. The feed roller 16 feeds the recording sheets P one by one from the paper tray 15. A recording sheet P fed from the paper tray 15 is conveyed toward the output tray 18 via the output roller pair 17 provided on top of the image forming apparatus 100. The output roller pair 17 discharges the recording sheet P onto an outside of the image forming apparatus 100, that is, onto the output tray 18. The output tray 18 stocks the recording sheets P fed by the output roller pair 17.

The conveyance path R is provided inside the image forming apparatus 100 to guide the recording sheet P from the paper tray 15 to the output tray 18. The registration roller pair 19 is provided between the feed roller 16 and the second transfer roller 12 in the conveyance path R. The fixing device 20 is provided in the conveyance path R at a position downstream from the second transfer roller 12 and upstream from the output roller pair 17 in a recording medium conveyance direction. The fixing device 20 fixes a toner image on the recording sheet P. The fixing device 20 includes the fixing roller 21 serving as a fixing member heated by a heat source, the pressing roller 22 serving as a rotary pressing member or an opposing member disposed opposite the fixing roller 21, and the separators 23. The pressing roller 22 presses against the fixing roller 21 to form a fixing nip N between the fixing roller 21 and the pressing roller 22. The separators 23 separate the recording sheet P from the fixing roller 21.

Referring to FIG. 2, the following describes an image forming operation of the image forming apparatus 100. When the image forming apparatus 100 receives a command to start an image forming operation, a driver drives and rotates the photoconductive drums 2 of the process units 1Y, 1C, 1M, and 1K, respectively, clockwise in FIG. 2. In the process units 1Y, 1C, 1M, and 1K, the charging rollers 3 uniformly charge the surfaces of the photoconductive drums 2 to have a given polarity, respectively. The exposure device 6 emits laser beams onto the charged surfaces of the photoconductive drums 2 to form electrostatic latent images on the surfaces of the photoconductive drums 2 according to image data corresponding to yellow, cyan, magenta, and black colors generated by separating full-color image data, respectively. The development devices 4 supply yellow, cyan, magenta, and black toners to the electrostatic latent images formed on the photoconductive drums 2 to make the electrostatic latent images visible as yellow, cyan, magenta, and black toner images, respectively.

A driver drives and rotates the driving roller 9 counterclockwise in FIG. 2 to move and rotate the intermediate transfer belt 8 in the rotation direction R1. A voltage controlled to have a constant voltage or current of a polarity opposite a polarity of the toners is applied to the first transfer rollers 11 so as to generate a transfer electric field at the first transfer nips between the first transfer rollers 11 and the photoconductive drums 2, respectively. The transfer electric field generated at the first transfer nips transfers the yellow, cyan, magenta, and black toner images formed on the photoconductive drums 2 of the process units 1Y, 1C, 1M, and 1K, respectively, onto the outer circumferential surface of the intermediate transfer belt 8 in such a manner that the yellow, cyan, magenta, and black toner images are superimposed on a same position on the intermediate transfer belt 8 sequentially. Thus, a full-color toner image is formed on the outer circumferential surface of the intermediate transfer belt 8.

The cleaning blades 5 remove residual toners remaining on the surfaces of the photoconductive drums 2 from the surfaces of the photoconductive drums 2 after the yellow, cyan, magenta, and black toner images are transferred from the photoconductive drums 2 onto the intermediate transfer belt 8, respectively. Dischargers discharge the surfaces of the photoconductive drums 2 to initialize a surface potential of the photoconductive drums 2 so that the photoconductive drums 2 are ready for a next image forming operation.

The feed roller 16 rotates and feeds a recording sheet P contained in the paper tray 15 toward the registration roller pair 19 in the conveyance path R. The registration roller pair 19 feeds the recording sheet P toward the second transfer nip foamed between the second transfer roller 12 and the driving roller 9 disposed opposite the second transfer roller 12 via the intermediate transfer belt 8 at a proper time. A transfer voltage having a polarity opposite the polarity of the toners forming the full-color toner image formed on the intermediate transfer belt 8 is applied to the second transfer roller 12 so as to generate a transfer electric field at the second transfer nip between the second transfer roller 12 and the intermediate transfer belt 8. The transfer electric field generated at the second transfer nip transfers the full-color toner image formed on the intermediate transfer belt 8 onto the recording sheet P at a time. The recording sheet P bearing the full-color toner image is sent to the fixing device 20. When the recording sheet P bearing the full-color toner image passes through the fixing nip N between the fixing roller 21 and the pressing roller 22, the fixing roller 21 and the pressing roller 22 apply heat and pressure to the recording sheet P to melt and fix the full-color toner image on the recording sheet P. The recording sheet P bearing the fixed full-color toner image is separated from the fixing roller 21 by the separators 23, and is sent to the output roller pair 17 so that the output roller pair 17 outputs the recording sheet P onto the output tray 18. The belt cleaner 13 removes residual toner remaining on the intermediate transfer belt 8 from the intermediate transfer belt 8 after the full-color toner image is transferred onto the recording sheet P. The removed toner is sent and collected into the waste toner container 14.

The above-described image forming operation forms the full-color toner image on the recording sheet P. Alternatively, the image forming apparatus 100 may form a monochrome toner image by using one of the four process units 1Y, 1C, 1M, and 1K, or may form a two-color toner image or a three-color toner image by using two or three of the four process units 1Y, 1C, 1M, and 1K.

Figure 3:
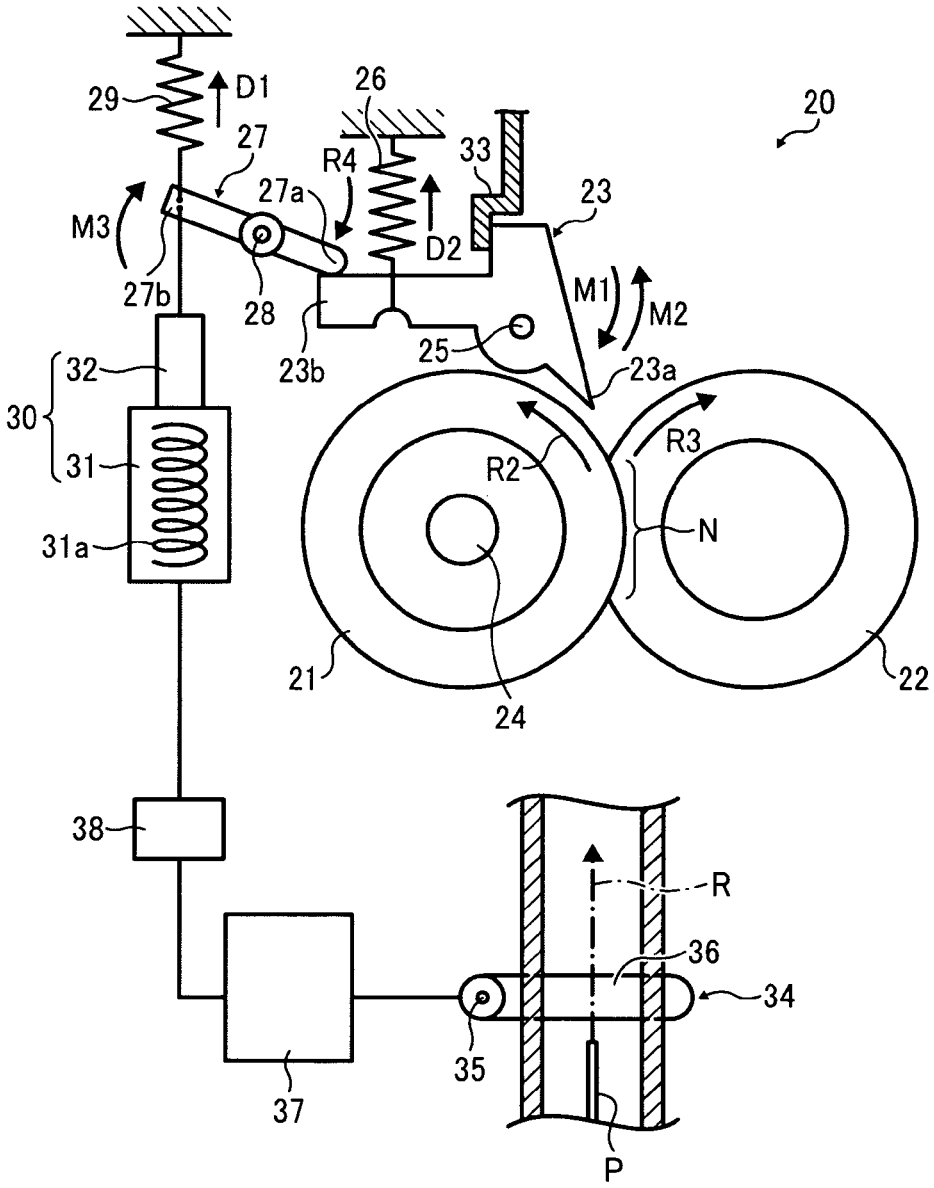
FIG. 3 is a schematic view (according to an example embodiment) of a fixing device included in the image forming apparatus shown in FIG. 2 when separators included in the fixing device are separated from a fixing roller included in the fixing device.
Figure 4:
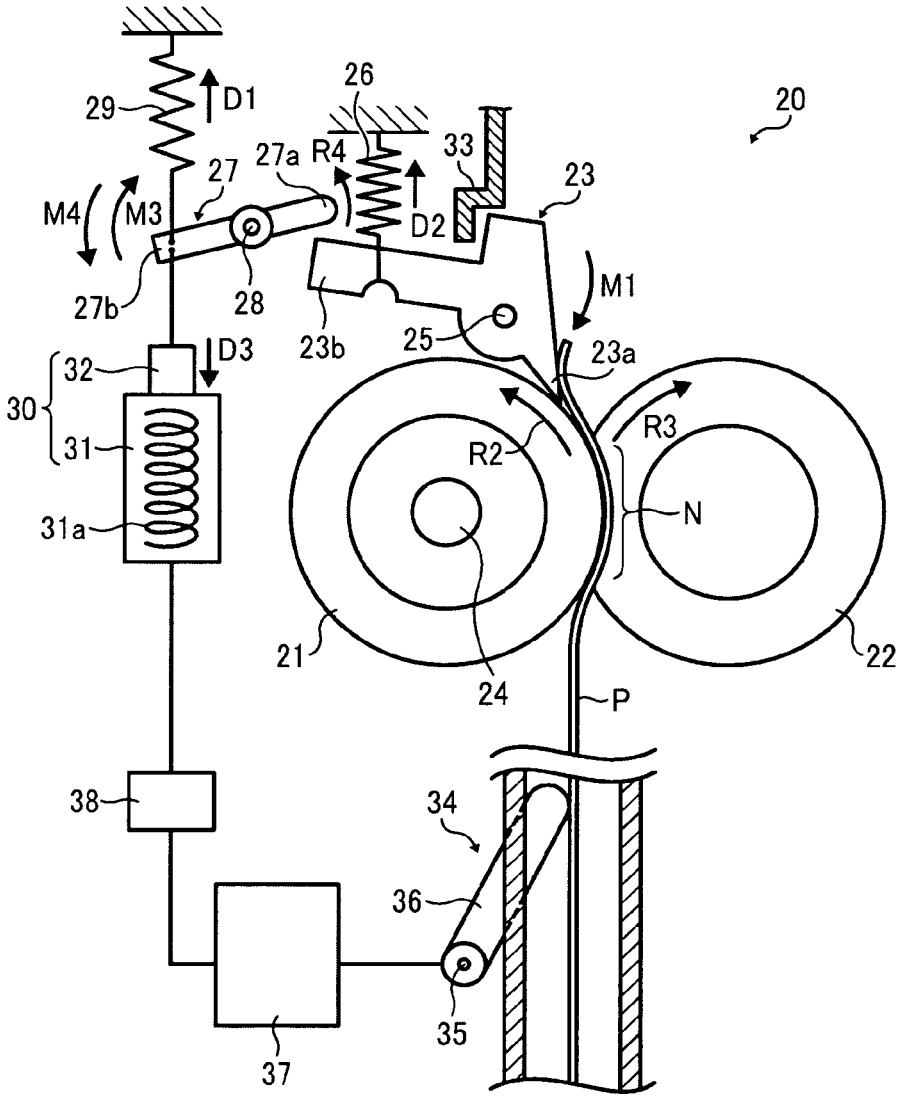
FIG. 4 is a schematic view (according to an example embodiment) of the fixing device shown in FIG. 3 when the separators contact the fixing roller.
Figure 5:
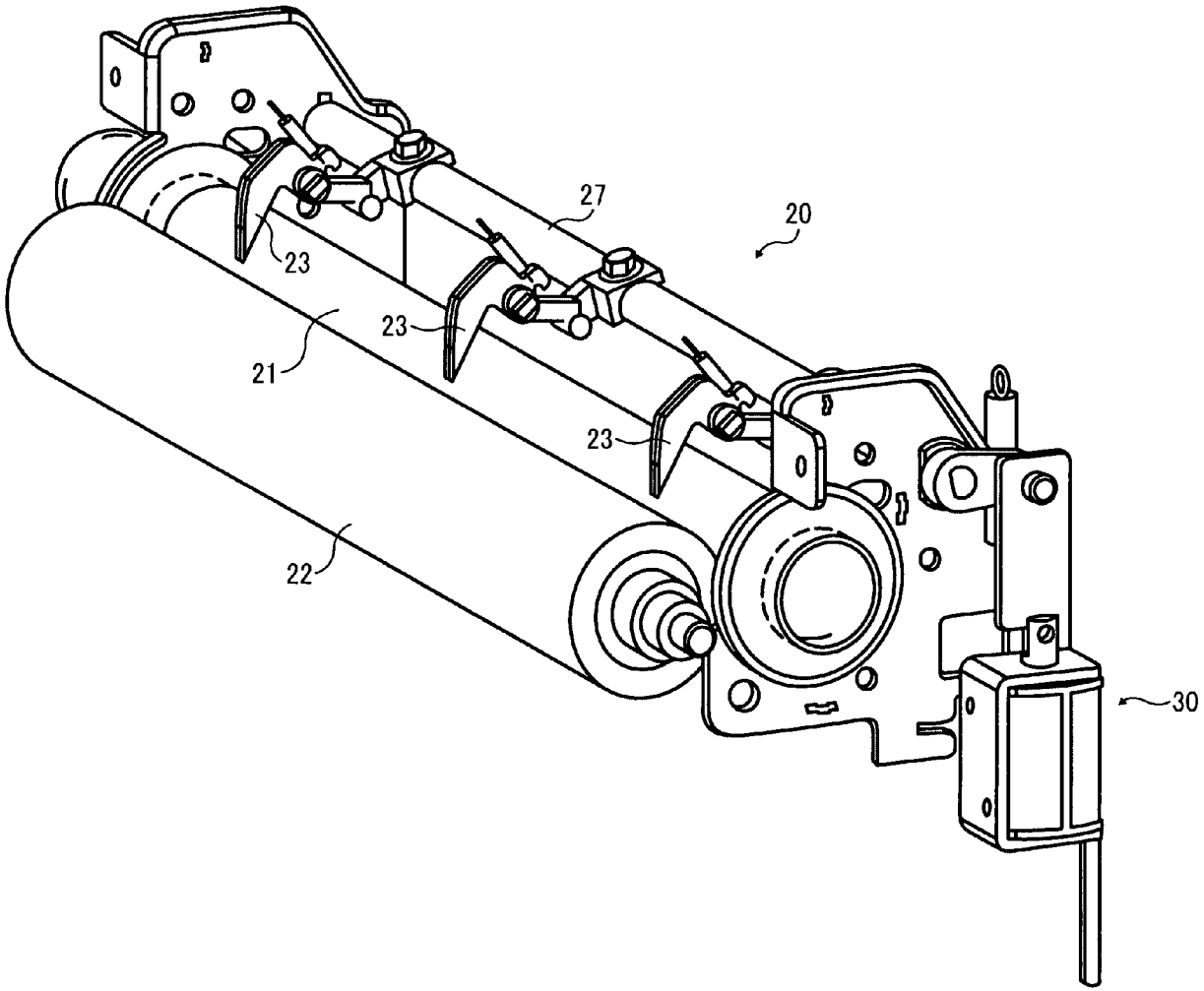
FIG. 5 is a perspective view (according to an example embodiment) of the fixing device shown in FIG. 3.

Referring to FIGS. 3 to 5, the following describes a structure of the fixing device 20.

FIGS. 3 and 4 illustrate a schematic view of the fixing device 20. FIG. 5 is a perspective view of the fixing device 20. As illustrated in FIGS. 3 and 4, the fixing device 20 further includes a heat source 24, an axis 25, a contact-direction biasing member 26, a releasing member 27, an axis 28, a release-direction biasing member 29, a solenoid 30, a stopper 33, a recording medium detector 34, a controller 37, and a driving circuit 38.

The separator 23 includes a front edge portion 23*a* and a base portion 23*b*. The releasing member 27 includes a front edge portion 27*a* and a base portion 27*b*. The solenoid 30 includes a body 31 and a plunger 32. The body 31 includes a coil 31*a*. The recording medium detector 34 includes an axis 35 and a detecting portion 36.

In the fixing device 20, the fixing roller 21 and the pressing roller 22 contact each other to form the fixing nip N. The heat source 24 is provided inside the fixing roller 21, and heats the fixing roller 21. The fixing roller 21 and the pressing roller 22 are rotatable in rotation directions R2 and R3, respectively.

The fixing roller 21 is a cylindrical member including a heat conductive base layer, an elastic layer provided on the base layer, and a covering layer covering the elastic layer. For example, the base layer has a desired mechanical strength, and includes a material having proper thermal conductivity such as carbon steel and/or aluminum. The elastic layer includes synthetic rubber such as silicon rubber and/or fluorocarbon rubber. The covering layer, which is provided on an outer side or an outer circumferential surface of the elastic layer, includes a material, having high thermal conductivity and high heat resistance to provide improved releasing property for releasing toner from the fixing roller 21 and improved durability of the elastic layer. For example, the covering layer may be a tube including fluorocarbon resin such as tetrafluoroethylene-perfluoroalkylvinylether copolymer (PFA), a coating layer coated with fluorocarbon resin such as PFA or polytetrafluoroethylene (PTFE), a silicon rubber layer, or a fluorocarbon rubber layer.

The pressing roller 22 is a cylindrical member including a metal core, an elastic layer provided on an outer side or an outer circumferential surface of the metal core, and a covering layer covering the elastic layer. For example, the metal core includes an STKM steel pipe classified under Carbon Steel Tubes for Machine Structural Purposes of Japanese Industrial Standards. The elastic layer includes silicon rubber, fluorocarbon rubber, silicon rubber foam, and/or fluorocarbon rubber foam. The covering layer includes a heat-resistant fluorocarbon resin tube including PFA and/or PTFE providing improved releasing property for releasing toner from the pressing roller 22.

A thermistor serving as a temperature detector for detecting temperature of the fixing roller 21 and a thermostat for preventing abnormal temperature increase of the fixing roller 21 are provided near the fixing roller 21. The thermostat controls the surface temperature of the fixing roller 21 within a given temperature range according to a detection signal provided by the thermistor.

The separators 23 are provided downstream from the fixing nip N in the recording medium conveyance direction, that is, at an upper position in FIGS. 3 and 4, to face the fixing roller 21. As illustrated in FIG. 5, three separators 23 are arranged in an axial direction of the fixing roller 21. However, the number of the separators 23 is not limited to three, and may be any number not smaller than two. Each of the separators 23 is supported by the axis 25 in such a manner that each of the separators 23 rotates about the axis 25 independently from each other. When the separators 23 rotate about the axes 25 clockwise or counterclockwise in FIG. 3, the front edge portions 23*a* of the separators 23 move close to and away from the fixing roller 21 independently from each other. FIG. 3 illustrates the separator 23 separated from the fixing roller 21. FIG. 4 illustrates the separator 23 contacting the fixing roller 21.

The separator 23 includes a material that facilitates releasing of the separator 23 from the fixing roller 21 and sliding of the separator 23 over the fixing roller 21, such as PFA, polyetherketone (PEK), and/or polyetheretherketone (PEEK). A surface of the separator 23 may be coated with a material that facilitates releasing and sliding of the separator 23, such as PFA and/or Teflon®.

The contact-direction biasing member 26 is provided on the base portion 23*b* of the separator 23 disposed opposite the front edge portion 23*a*. According to this example embodiment, an extension coil spring is used as the contact-direction biasing member 26. Alternatively, a compression coil spring, a torsion coil spring, or other biasing member may be used as the contact-direction biasing member 26 according to various conditions, such as installation space and manufacturing costs. The contact-direction biasing member 26 biases the separator 23 in a direction in which the separator 23 moves toward the fixing roller 21 to contact the fixing roller 21.

The releasing member 27 is provided on the base portion 23*b* of the separator 23 to release contact of the separator 23 to the fixing roller 21. The axis 28 supports the releasing member 27 in such a manner that the releasing member 27 is rotatable about the axis 28. When the releasing member 27 rotates about the axis 28 clockwise or counterclockwise in FIG. 3, the front edge portion 27*a* of the releasing member 27 facing the separator 23 moves close to and away from the base portion 23*b* of the separator 23. The releasing member 27 extends in a direction parallel to the axial direction of the fixing roller 21 to contact all of the plurality of separators 23.

The releasing member 27 may include a heat-resistant, durable resin material such as polyphenylene sulphide (PPS) and/or PEK, which is lightweight and has a desired mechanical strength. According to this example embodiment, the axis 28, that is, a rotation shaft of the releasing member 27, is separately provided from the releasing member 27 and includes SUS stainless steel so as to prevent bending of the releasing member 27 in an axial direction, that is, in a longitudinal direction of the releasing member 27. The material of the releasing member 27 may be determined according to the size of the fixing device 20 and a biasing force applied to the separator 23 by the contact-direction biasing member 26.

The release-direction biasing member 29 is provided on the base portion 27*b* of the releasing member 27 disposed opposite the front edge portion 27*a*. According to this example embodiment, an extension coil spring is used as the release-direction biasing member 29. Alternatively, a compression coil spring, a torsion coil spring, or other biasing member may be used as the release-direction biasing member 29 according to various conditions, such as installation space and manufacturing costs. The release-direction biasing member 29 biases the releasing member 27 in a direction in which the releasing member 27 moves toward the separator 23 to contact the separator 23.

The solenoid 30 serves as a driver for driving the releasing member 27. The solenoid 30 includes the body 31 inside which the coil 31*a* is provided, and the plunger 32 that moves into and out of the coil 31*a*. The plunger 32 is connected to the base portion 27*b* of the releasing member 27 to which the release-direction biasing member 29 is connected. When the coil 31*a* provided inside the body 31 is excited, and the plunger 32 is pulled into the body 31, the releasing member 27 is driven and rotated.

The stopper 33 is provided above the separator 23 in FIG. 3 to stop the separator 23 at a given position at which the separator 23 is separated from the fixing roller 21. The stopper 33 serves as a part of an exit guide provided downstream from the fixing nip N in the recording medium conveyance direction to guide the recording sheet P discharged from the fixing nip N. When the separator 23 contacts the stopper 33, the stopper 33 stops the separator 23 at a predetermined distance from the fixing roller 21. Thus, the stopper 33 maintains a desired distance between the separator 23 and the surface of the fixing roller 21 regardless of variation in size or assembly of the components of the plurality of separators 23.

The recording medium detector 34 is provided upstream from the fixing nip N in the recording medium conveyance direction and below the fixing nip N in FIGS. 3 and 4, and detects the recording sheet P. In the recording medium detector 34, the axis 35 supports the detecting portion 36 in such a manner that the detecting portion 36 is swingable or rotatable about the axis 35. As illustrated in FIG. 3, before the recording sheet P contacts the recording medium detector 34, the detecting portion 36 is at a standby position at which the detecting portion 36 intersects with the conveyance path R for conveying the recording sheet P. When the recording sheet P contacts the detecting portion 36, the detecting portion 36 swings as illustrated in FIG. 4 and detects the recording sheet P. After the recording sheet P passes through the detecting portion 36, weight of the detecting portion 36 or a biasing member (e.g., a torsion coil spring) returns the detecting portion 36 to the standby position illustrated in FIG. 3. For example, the detecting portion 36 contacts a stopper, and the stopper stops the detecting portion 36 at the standby position.

The detecting portion 36 may be provided near a center of the conveyance path R in a width direction of the conveyance path R perpendicular to the recording medium conveyance direction so that the recording sheet P is not skewed when the recording sheet P contacts the detecting portion 36. Thus, the detecting portion 36 conveys the recording sheet P properly with improved conveyance reliability to prevent distortion of the toner image on the recording sheet P and creasing of the recording sheet P.

Figure 6:
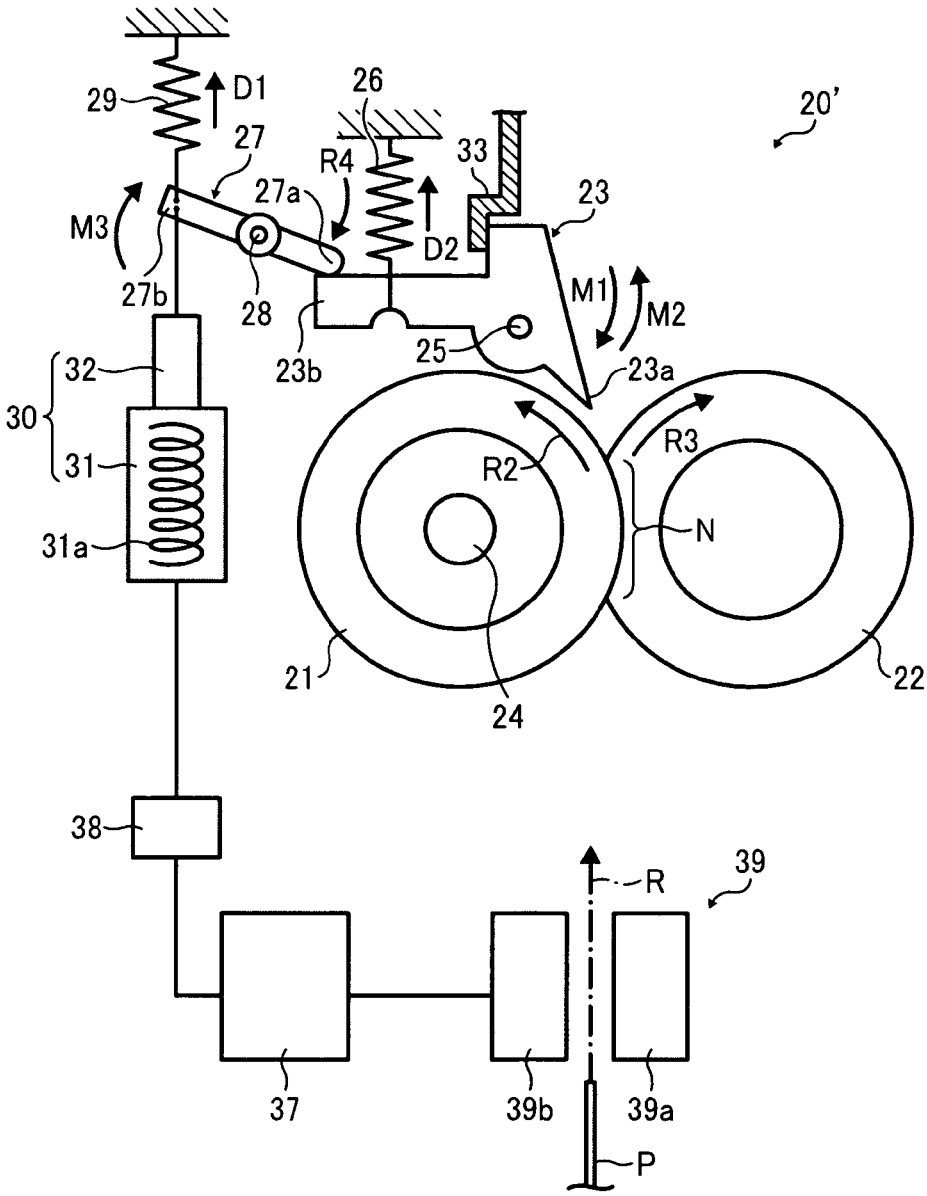
FIG. 6 is a schematic view of a fixing device according to another example embodiment.

According to this example embodiment, the fixing device 20 includes the recording medium detector 34 serving as a contact type detector that detects the recording sheet P by contacting the recording sheet P. Alternatively, the fixing device 20 may include a non-contact type detector that detects the recording sheet P without contacting the recording sheet P. FIG. 6 is a schematic view of a fixing device 20' including such non-contact type detector. As illustrated in FIG. 6, the fixing device 20' includes an optical sensor 39. The optical sensor 39 includes a light emitter 39*a* and a light receiver 39*b*. The optical sensor 39 replaces the recording medium detector 34 depicted in FIG. 3. The other elements of the fixing device 20' are equivalent to the elements of the fixing device 20 depicted in FIG. 3.

The transmission type optical sensor 39 is provided upstream from the fixing nip N in the recording medium conveyance direction, and serves as a non-contact type detector that detects the recording sheet P conveyed toward the fixing nip N without contacting the recording sheet P. The optical sensor 39 includes the light emitter 39*a* and the light receiver 39*b* sandwiching the conveyance path R on which the recording sheet P is conveyed toward the fixing nip N. The light emitter 39*a* emits light toward the light receiver 39*b*. When the recording sheet P passing between the light emitter 39*a* and the light receiver 39*b* blocks the light emitted by the light emitter 39*a* toward the light receiver 39*b*, the optical sensor 39 detects the recording sheet P. By contrast, when the light receiver 39*b* receives the light emitted by the light emitter 39*a* toward the light receiver 39*b*, the optical sensor 39 does not detect the recording sheet P.

Alternatively, a reflection type optical sensor may be used as a non-contact type detector. The non-contact type detector may not skew the conveyed recording sheet P.

The recording medium detector 34 depicted in FIG. 3 or the optical sensor 39 depicted in FIG. 6 may serve as a jam detector for detecting a jammed recording sheet P. In other words, when a jam detector is provided upstream from the fixing nip N in the recording medium conveyance direction to detect the jammed recording sheet P, the jam detector may also serve as the recording medium detector 34 or the optical sensor 39. Accordingly, a separate detector for detecting the recording sheet P is not needed, resulting in the downsized fixing device 20 or 20' and reduced manufacturing costs of the fixing device 20 or 20'.

The solenoid 30 is driven according to a detection signal provided by the recording medium detector 34 or the optical sensor 39. For example, the solenoid 30 is electrically connected to the recording medium detector 34 or the optical sensor 39 via the driving circuit 38 and the controller 37. The controller 37 is a central processing unit (CPU) inside which an input/output (I/O) port is provided. When the recording medium detector 34 or the optical sensor 39 detects the conveyed recording sheet P, the controller 37 drives the solenoid 30 via the driving circuit 38 according to a detection signal provided by the recording medium detector 34 or the optical sensor 39.

Referring to FIGS. 3 and 4, the following describes operations of the fixing device 20.

Before the recording sheet P contacts the recording medium detector 34 as illustrated in FIG. 3, the recording medium detector 34 does not detect the recording sheet P. Accordingly, the solenoid 30 does not generate a driving force, and therefore the releasing member 27 does not receive the driving force from the solenoid 30. By contrast, the releasing member 27 receives a biasing force applied by the release-direction biasing member 29. For example, when the release-direction biasing member 29 pulls the base portion 27*b* of the releasing member 27 upward in a direction D1 in FIG. 3, a force in a clockwise direction, that is, a rotation moment M3, is applied to the releasing member 27. The rotation moment M3 causes the front edge portion 27*a* of the releasing member 27 to press the base portion 23*b* of each of the separators 23 downward.

When the releasing member 27 presses the base portion 23*b* of each of the separators 23 downward, a force in a counterclockwise direction, that is, a rotation moment M2, is applied to each of the separators 23. When the contact-direction biasing member 26 pulls the base portion 23*b* of the separator 23 upward in a direction D2, a force in a clockwise direction, that is, a rotation moment M1, is applied to the separator 23. Thus, each of the separators 23 is applied with the rotation moment M1 and the rotation moment M2 opposite the rotation moment M1. However, the force in the counterclockwise direction, that is, the rotation moment M2, is greater than the force in the clockwise direction, that is, the rotation moment M1. Accordingly, the front edge portion 23*a* of each of the separators 23 separates from the fixing roller 21.

In other words, when the recording sheet P is not supplied to the fixing nip N, the rotation moment M2, that is, the force applied by the release-direction biasing member 29 to the separators 23 via the releasing member 27 in a direction to separate the separators 23 from the fixing roller 21, is greater than the rotation moment M1, that is, the force applied by the contact-direction biasing members 26 to the separators 23 in a direction to cause the separators 23 to contact the fixing roller 21. Accordingly, the separators 23 are separated from the fixing roller 21 to suppress wear of the fixing roller 21 due to contact of the separators 23 to the fixing roller 21. Consequently, proper fixing of the toner image on the recording sheet P can be maintained for longer time. The stopper 33, which contacts the separator 23, maintains a given distance between the separator 23 and the fixing roller 21.

When the recording sheet P contacts the detecting portion 36 of the recording medium detector 34 and therefore the recording medium detector 34 detects the recording sheet P as illustrated in FIG. 4, the controller 37 drives the solenoid 30 via the driving circuit 38 according to a detection signal provided by the recording medium detector 34. For example, when a given electric current is applied to the solenoid 30, the plunger 32 is pulled into the body 31. Accordingly, the base portion 27*b* of the releasing member 27 is pulled downward in a direction D3, and a force in a counterclockwise direction, that is, a rotation moment M4, is applied to the releasing member 27. On the other hand, the release-direction biasing member 29 applies the rotation moment M3, that is, the force in the clockwise direction. However, the rotation moment M4, that is, the force in the counterclockwise direction applied by the solenoid 30, is greater than the rotation moment M3. Accordingly, the releasing member 27 rotates counterclockwise in a rotation direction R4. Consequently, the front edge portion 27*a* of the releasing member 27 separates from the base portion 23*b* of each of the separators 23 to release pressure applied by the releasing member 27 to the separators 23.

When pressure applied by the releasing member 27 to each of the separators 23 is released, the separator 23 is applied with the rotation moment M1 only, that is, the force in the clockwise direction applied by the contact-direction biasing member 26. Accordingly, the separators 23 rotate clockwise in FIG. 4, and the front edge portion 23*a* of each of the separators 23 contacts the fixing roller 21. Consequently, the separators 23 separate the recording sheet P discharged from the fixing nip N from the fixing roller 21.

Thereafter, when a trailing edge of the recording sheet P passes through the fixing nip N, the controller 37 breaks the electric current applied to the solenoid 30 to release the plunger 32 pulled into the body 31. Accordingly, the force applied by the release-direction biasing member 29 to the releasing member 27, that is, the rotation moment M3, causes the releasing member 27 to press against each of the separators 23. The pressing force of the releasing member 27 applies the rotation moment M2, that is, the force in the counterclockwise direction in FIG. 3, to the separators 23 again. As described above, the rotation moment M2 applied to the separator 23 in the counterclockwise direction is greater than the rotation moment M1 applied by the contact-direction biasing member 26 to the separator 23 in the clockwise direction. Accordingly, each of the separators 23 rotates counterclockwise in FIG. 3 so that the front edge portion 23*a* of each of the separators 23 separates from the fixing roller 21. Thus, whenever the recording sheet P is supplied to the fixing nip N, the separators 23 contact and separate from the fixing roller 21 as described above.

Figure 7:
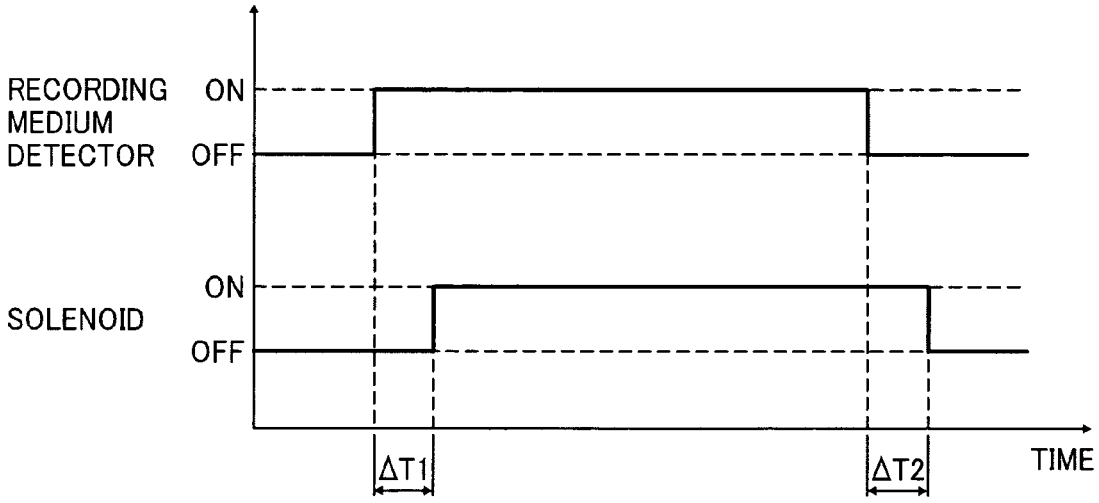
FIG. 7 is a timing chart (according to an example embodiment) showing operations of a recording medium detector and a solenoid included in the fixing device shown in FIG. 3.

FIG. 7 is a timing chart showing operations of the recording medium detector 34 and the solenoid 30 depicted in FIGS. 3 and 4.

As illustrated in FIG. 7, the solenoid 30 is turned on when a given time period ΔT1 elapses after the recording medium detector 34 detects the recording sheet P, that is, after the recording medium detector 34 is turned on. For example, the recording sheet P contacts the separators 23 when a given time period elapses after the recording medium detector 34 detects the recording sheet P. Accordingly, the controller 37 does not drive the solenoid 30 immediately after the recording medium detector 34 detects the recording sheet P to cause the separators 23 to contact the fixing roller 21, but drives the solenoid 30 to cause the separators 23 to contact the fixing roller 21 immediately before the recording sheet P contacts the separators 23, so as to reduce wear of the fixing roller 21.

The solenoid 30 is turned off when a given time period ΔT2 elapses after the recording medium detector 34 no longer detects the recording sheet P, that is, after the recording medium detector 34 is turned off. If the controller 37 stops driving the solenoid 30 immediately after the recording medium detector 34 does not detect the recording sheet P, the separators 23 may separate from the fixing roller 21 before the trailing edge of the recording sheet P passes through the separators 23, degrading separation of the recording sheet P from the fixing roller 21 and conveyance of the recording sheet P.

The time periods ΔT1 and ΔT2 may be adjusted according to a conveyance speed of the recording sheet P, for example, to cause the separators 23 to contact and separate from the fixing roller 21 at desired times, respectively, thus providing improved separation of the recording sheet P from the fixing roller 21 effectively.

According to the above-described example embodiments, the plurality of separators 23 contacts and separates from the fixing roller 21 independently from each other. Accordingly, even when the plurality of separators 23 varies in dimension or the fixing roller 21 is bent or vibrates, all of the plurality of separators 23 contacts the surface of the fixing roller 21 precisely, providing improved separation of the recording sheet P from the fixing roller 21 stably and improved reliability.

The releasing member 27 causes the plurality of separators 23 to contact and separate from the fixing roller 21 simultaneously by using the single driver, that is, the solenoid 30. In other words, a plurality of drivers is not needed to drive the plurality of separators 23, improving reliability of contact and separate operations of the separators 23, downsizing the fixing device 20 or 20', and reducing manufacturing costs of the fixing device 20 or 20'.

As illustrated in FIG. 4, when the separators 23 contact the fixing roller 21, the releasing member 27 does not contact the separators 23. Accordingly, the separators 23 do not receive a force from the releasing member 27. In other words, only a biasing force applied by the contact-direction biasing member 26 to the separator 23 causes the separator 23 to contact the fixing roller 21. Thus, the front edge portion 23*a* of the separator 23, that is, a contact portion of the separator 23 that contacts the fixing roller 21, slides over the surface of the fixing roller 21 smoothly with appropriate pressure applied to the fixing roller 21.

According to the above-described example embodiments, a general-purpose solenoid is used as the solenoid 30 serving as a driver, suppressing manufacturing costs and providing operation reliability. When the solenoid 30 is not driven as illustrated in FIG. 3, a relation between the force applied by the contact-direction biasing member 26 to the separator 23 and the force applied by the release-direction biasing member 29 to the separator 23 via the releasing member 27 separates the separator 23 from the fixing roller 21. In other words, the solenoid 30 is driven only to cause the separators 23 to contact the fixing roller 21. Accordingly, the driver is simplified. Generally, a time period in which the separators 23 contact the fixing roller 21 is shorter than a time period in which the separators 23 are separated from the fixing roller 21. Accordingly, the solenoid 30 is driven only to cause the separators 23 to contact the fixing roller 21 to decrease power distribution to the solenoid 30 and suppress decrease in driving force of the plunger 32 due to self-heating.

In the fixing device 20 or 20' according to the above-described example embodiments, the fixing roller 21 is used as a fixing member and the pressing roller 22 is used as an opposing member disposed opposite the fixing member. Alternatively, the fixing member and the opposing member may not be a roller. For example, at least one of the fixing member and the opposing member may be a belt, a film, a pad, or a plate. According to the above-described example embodiments, the fixing device 20 or 20' is installed in the image forming apparatus 100 serving as a color image forming apparatus for forming a color image. Alternatively, the fixing device 20 or 20' may be installed in a monochrome image foaming apparatus for forming a monochrome image, a copier, a printer, a facsimile machine, a multifunction printer having at least one of copying, printing, and facsimile functions, or the like.

Referring to FIGS. 3 and 4, the following describes effects provided by the fixing device 20 or 20'. As described above, in a fixing device (e.g., the fixing device 20 depicted in FIG. 3 or the fixing device 20' depicted in FIG. 6), an opposing member (e.g., the pressing roller 22) disposed opposite a fixing member (e.g., the fixing roller 21) contacts the fixing member to form a nip (e.g., the fixing nip N) between the fixing member and the opposing member through which a recording medium (e.g., a recording sheet P) bearing a toner image passes. While the recording medium passes through the nip, the fixing member and the opposing member fix the toner image on the recording medium. A plurality of separators (e.g., the separators 23) provided downstream from the nip in a recording medium conveyance direction contacts and separates from the fixing member independently from each other. The plurality of separators contacts the fixing member to separate the recording medium that has passed between the fixing member and the opposing member from the fixing member. A plurality of contact-direction biasing members (e.g., the contact-direction biasing members 26) connected to the plurality of separators biases the plurality of separators to cause the plurality of separators to contact the fixing member. A releasing member (e.g., the releasing member 27) is driven by a single driver (e.g., the solenoid 30), and is rotatively provided to contact and separate from the plurality of separators. When the releasing member is not driven by the driver, the releasing member releases contact of the plurality of separators to the fixing member.

The driver drives the releasing member to cause the plurality of separators to contact the fixing member. Accordingly, when the recording medium is supplied to the nip, the driver connected to the releasing member separates the releasing member from the plurality of separators to cause the plurality of contact-direction biasing members connected to the plurality of separators to cause the plurality of separators to contact the fixing member, so that the plurality of separators separates the recording medium from the fixing member properly. By contrast, when the recording medium is not supplied to the nip, the releasing member contacts the plurality of separators to cause the plurality of separators to separate from the fixing member against the bias of the plurality of contact-direction biasing members, suppressing wear of the fixing member and providing desired image formation for longer time.

The plurality of separators contacts and separates from the fixing member independently from each other. Accordingly, even when the plurality of separators varies in dimension or the fixing member is bent or vibrates, all of the plurality of separators contacts the surface of the fixing member precisely. Further, the single driver drives the plurality of separators.

A release-direction biasing member (e.g., the release-direction biasing member 29) connected to the releasing member biases the releasing member to cause the releasing member to contact the plurality of separators to separate the plurality of separators from the fixing member.

The plurality of contact-direction biasing members applies a first force (e.g., the rotation moment M1) to the plurality of separators in a first direction to cause the plurality of separators to contact the fixing member. The release-direction biasing member applies a second force (e.g., the rotation moment M2) to the plurality of separators via the releasing member in a second direction to separate the plurality of separators from the fixing member. The release-direction biasing member applies a third force (e.g., the rotation moment M3) to the releasing member in a third direction to cause the releasing member to contact the plurality of separators. The driver applies a fourth force (e.g., the rotation moment M4) to the releasing member in a fourth direction to separate the releasing member from the plurality of separators when the driver is driven. The second force is greater than the first force, and the fourth force greater than the third force is applied in the fourth direction opposite the third direction of the third force.

Accordingly, when the driver is not driven, the relation between the first force applied by the plurality of contact-direction biasing members and the third force applied by the release-direction biasing member separates the plurality of separators from the fixing member. In other words, the driver is driven only to cause the plurality of separators to contact the fixing member, simplifying the driver.

The driver may be a solenoid (e.g., the solenoid 30) including a coil (e.g., the coil 31*a*) and a plunger (e.g., the plunger 32) movably provided inside the coil. When the solenoid is turned on, the plunger is pulled into the coil to cause the driver to apply the fourth force to the releasing member.

The general-purpose solenoid is used as the driver to suppress manufacturing costs and enhance operation reliability. Generally, a time period in which the plurality of separators contacts the fixing member is shorter than a time period in which the plurality of separators separates from the fixing member. Accordingly, the solenoid is driven only when the plurality of separators needs to contact the fixing member, decreasing power distribution to the solenoid and suppressing decrease in driving force of the plunger due to self-heating.

When the plurality of separators is separated from the fixing member, a plurality of stoppers (e.g., the stoppers 33) contacts and stops the plurality of separators at a predetermined distance from the fixing member, that is, at a given distance provided between the plurality of separators and the surface of the fixing member.

Accordingly, even with variation in dimension or assembly of the components included in the plurality of separators, an appropriate distance is maintained between the plurality of separators and the surface of the fixing member.

In a state in which the plurality of separators contacts the fixing member, the releasing member does not contact the plurality of separators.

Accordingly, the plurality of separators contacting the fixing member does not receive a force from the releasing member. Consequently, the plurality of separators contacts the fixing member by the first force applied by the plurality of contact-direction biasing members only. Thus, a contact portion (e.g., the front edge portion 23*a*) of each of the plurality of separators contacts and slides over the surface of the fixing member smoothly with appropriate pressure applied to the fixing member.

A recording medium detector (e.g., the recording medium detector 34 depicted in FIG. 3 or the optical sensor 39 depicted in FIG. 6) is provided upstream from the nip in the recording medium conveyance direction, and detects the recording medium. A controller (e.g., the controller 37) connected to the driver controls the driver according to a detection signal provided by the recording medium detector.

Accordingly, before the recording medium reaches the plurality of separators, the controller drives the driver to cause the plurality of separators to contact the fixing member so that the plurality of separators separates the recording medium from the fixing member precisely.

The recording medium detector may be a contact type detector (e.g., the recording medium detector 34) that detects the recording medium by contacting the recording medium conveyed toward the nip. The contact type detector includes a detecting portion (e.g., the detecting portion 36) that contacts the recording medium and is provided near a center of a recording medium conveyance path (e.g., the conveyance path R) in a width direction of the recording medium conveyance path perpendicular to the recording medium conveyance direction.

Accordingly, even when the recording medium contacts the detecting portion of the recording medium detector, the recording medium is not skewed, preventing distortion of the toner image on the recording medium and creasing of the recording medium.

The recording medium detector may be a non-contact type detector (e.g., the optical sensor 39) that detects the recording medium without contacting the recording medium conveyed toward the nip. Accordingly, the recording medium does not contact the recording medium detector, preventing skew of the recording medium.

A jam detector (e.g., the recording medium detector 34 or the optical sensor 39) is provided upstream from the nip in the recording medium conveyance direction, and detects a jammed recording medium. The jam detector also serves as the recording medium detector for detecting the recording medium. Accordingly, a separate detector for detecting the recording medium is not needed, resulting in the downsized fixing device and reduced manufacturing costs of the fixing device.

The controller varies a time period that elapses before the controller starts driving the driver after the recording medium detector detects the recording medium. Accordingly, the plurality of separators contacts and separates from the fixing member at a desired time to separate the recording medium from the fixing member effectively.

The fixing device is installed in an image forming apparatus (e.g., the image forming apparatus 100 depicted in FIG. 2).

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing member;

an opposing member disposed opposite the fixing member to contact the fixing member to form a nip between the fixing member and the opposing member through which a recording medium bearing a toner image passes;

a plurality of separators provided downstream from the nip in a recording medium conveyance direction to contact and separate from the fixing member independently from each other, the plurality of separators having a base portion hingedly connected to a front portion that contacts the fixing member to separate the recording medium having passed between the fixing member and the opposing member from the fixing member;

a plurality of contact-direction biasing members connected to the front portion of the plurality of separators to bias the plurality of separators to cause the plurality of separators to contact the fixing member;

a rotatable releasing member, that rotates around an axis of a shaft, the base portion of the plurality of separators being affixed to the shaft, the releasing member contacting the plurality of separators to cause the plurality of separators to separate from the fixing member against the bias of the plurality of contact-direction biasing members; and a driver connected to the releasing member to separate the releasing member from the plurality of separators to cause the plurality of contact-direction biasing members connected to the plurality of separators to cause the plurality of separators to contact the fixing member.

2. The fixing device according to claim 1, further comprising a release-direction biasing member connected to the releasing member to bias the releasing member to cause the releasing member to contact the plurality of separators to separate the plurality of separators from the fixing member, wherein the plurality of contact-direction biasing members applies a first force to the plurality of separators in a first direction to cause the plurality of separators to contact the fixing member, the release-direction biasing member applies a second force to the plurality of separators via the releasing member in a second direction to separate the plurality of separators from the fixing member, the release-direction biasing member applies a third force to the releasing member in a third direction to cause the releasing member to contact the plurality of separators, and the driver applies a fourth force to the releasing member in a fourth direction to separate the releasing member from the plurality of separators when the driver is driven, and wherein the second force is greater than the first force, and the fourth force greater than the third force is applied in the fourth direction opposite the third direction of the third force.

3. The fixing device according to claim 2, wherein the driver comprises a solenoid comprising:

a coil; and a plunger movably provided inside the coil, and wherein when the solenoid is turned on, the plunger is pulled into the coil to cause the driver to apply the fourth force to the releasing member.

4. The fixing device according to claim 1, further comprising a plurality of stoppers to contact and stop the plurality of separators, respectively, wherein when the plurality of separators is separated from the fixing member, the plurality of stoppers stops the plurality of separators at a predetermined distance from the fixing member.

5. The fixing device according to claim 1, wherein, in a state in which the plurality of separators contacts the fixing member, the releasing member does not contact the plurality of separators.

6. The fixing device according to claim 1, further comprising:

a recording medium detector provided upstream from the nip in the recording medium conveyance direction to detect the recording medium; and a controller connected to the driver to control the driver according to a detection signal provided by the recording medium detector.

7. The fixing device according to claim 6, wherein the recording medium detector comprises a contact type detector to detect the recording medium by contacting the recording medium conveyed toward the nip, the contact type detector comprising a detecting portion provided near a center of a recording medium conveyance path in a width direction of the recording medium conveyance path perpendicular to the recording medium conveyance direction to contact the recording medium.

8. The fixing device according to claim 6, wherein the recording medium detector comprises a non-contact type detector to detect the recording medium without contacting the recording medium conveyed toward the nip.

9. The fixing device according to claim 1, further comprising a jam detector provided upstream from the nip in the recording medium conveyance direction to detect a jammed recording medium.

10. The fixing device according to claim 6, wherein the controller varies a time period that elapses before the controller starts driving the driver after the recording medium detector detects the recording medium.

11. An image forming apparatus comprising the fixing device according to claim 1.

12. The fixing device according to claim 1, wherein each of the plurality of separators is supported by its own axis such that each of the plurality of separators rotates about its axis independently of each other.

13. The fixing device according to claim 12, wherein the releasing member is a rotational shaft that extends in a direction parallel to an axial direction of the fixing member and has the protruding member positionally corresponding to the plurality of separators and wherein the protruding member directly contacts the respective separator and physically separates from the respective separator.

14. The fixing device according to claim 2, wherein the plurality of contact-direction biasing members are directly attached to a base portion of the separators and the release-direction biasing member is directly attached to a rear edge of the releasing member.

* * * * *